United States Patent [19]

Roberts

[11] Patent Number: 4,640,268

[45] Date of Patent: Feb. 3, 1987

[54] MUSCULAR REHABILITATION APPARATUS FOR EXERCISING HUMAN BODY APPENDAGES

[76] Inventor: Bobby S. Roberts, 5504 Camphor St., Metairie, La. 70003

[21] Appl. No.: 709,512

[22] Filed: Mar. 7, 1985

[51] Int. Cl.[4] ..... A61H 1/02

[52] U.S. Cl. ..... 128/25 R; 272/143; 272/DIG. 4

[58] Field of Search ..... 128/25 R, 25 B, 26; 272/117, 130; 272/93, 118, 127–132, 134–139, 142, 78, DIG. 4

[56] References Cited

U.S. PATENT DOCUMENTS

| | | | |
|---|---|---|---|
| 430,808 | 6/1890 | Naish | 128/25 R |
| 3,374,675 | 3/1968 | Keropian | 272/130 |
| 4,149,713 | 4/1979 | McLeod | 272/117 |
| 4,354,675 | 10/1982 | Barclay et al. | 272/118 |
| 4,491,316 | 1/1985 | Prince | 272/78 |

FOREIGN PATENT DOCUMENTS

| | | | |
|---|---|---|---|
| 1254913 | 12/1957 | France | 128/25 R |

*Primary Examiner*—Richard J. Apley

*Assistant Examiner*—John Welsh

*Attorney, Agent, or Firm*—Pravel, Gambrell, Hewitt & Kimball

[57] ABSTRACT

A muscular rehabilitation apparatus for exercising human body appendages through multiple geometric positions of the appendage with respect to the body including a support position with a curved track adjustably mounted with respect to a base and supported by the base. The track defines an arcuate path which tracks the outer extremity of a human appendage as it pivots about a joint, such as for example the movement of a hand at the end of an outstretched arm as the arm pivots at the shoulder. Another example includes the pivotal movement of a leg about the hip wherein the curved track follows the movement of the foot. A carriage is mounted to move upon the track between the end portions of the track and forms a connection between the appendage extremity such as for example, the hand or the foot with the track. The universal adjustment between the curved track and the support base allows an almost endless degree of adjustment so that the entire muscular group associated with a particular appendage can be fully developed.

10 Claims, 5 Drawing Figures

MUSCULAR REHABILITATION APPARATUS FOR EXERCISING HUMAN BODY APPENDAGES

BACKGROUND OF THE INVENTION

Field of the Invention

The present invention relates to muscular rehabilitation equipment and more particularly relates to an improved muscular rehabilitation apparatus which moves the extremity of human body appendages through multiple geometric positions of appendage with respect to the body.

General Background

The rehabilitation of certain muscular groups usually requires the movement of body appendages such as arms and legs through a selected range of motion. In order to properly rehabilitate muscle groups associated with the movement of appendages, it is desirable to perfect movement into a multitude of geometric positions including, for example positions wherein the arms are above the head, positions wherein the arms are lowered below the head, and positions wherein the arms are in a middle position. Further, it is desirable to move the arm in a pivotal fashion with respect to the shoulder joint from positions above the head to below the head in an upward downward generally vertical movement. Muscular rehabilitation can also involve an angular movement of the arms with respect to the body while the arms pivot or rotate about the shoulder joint. The multi-angular movement of the leg through various rotational positions of the leg about the hip is also desirable in the rehabilitation of muscular groups associated with the legs.

One of the problems associated with many rehabilitation programs and with machines which require rehabilitation is that these devices do not afford a comprehensive range of motion which allows particularization of a program to an individual's needs. Many machines or exercising devices are generally fixed with respect to their movement so as to develop only a very small group of muscles as the appendages are exercised in a repetitive pattern. Further, the patient cannot usually perform repetitive exercises with any degree of precision. Another problem is the limitation of a therapist's time to adequately supervise the program of a particular patient.

One of the major problems associated with the rehabilitation of appendages and the supporting muscularture and rotating joints is the structured, progressive therapy required to regain full range of motion. This requires a physical therapist to provide specific manipulation on a one to one basis in an in-patient or out-patient clinical setting. Patients are often given prescribed exercises to complete in their homes to provide continued improvement in the rehabilitation process.

Movement of appendages and the supporting rotating joints are based on arcial movements along a 360° circular rotation. A physical therapist will provide active or passive therapy and/or modalities of treatment in achieving the exercise of appendages and supporting muscularture and rotating joints. The physical therapist's training allows for following the physician's prescription to achieve full range of motion after acute care is completed.

Individual patients, however, are not trained on the anatomical make-up of the body and the process and procedures of rehabilitating appendages and the supporting muscularture and rotating joints. A degree of pain in the muscles and other soft tissue are almost always associated with the rehabilitation of appendages and the supporting muscularture and rotating joints.

During the primary phase of treatment physicians and therapist can ensure appropriate rehabilitation procedures are followed and that patient education occurs in relation to any pain and/or discomfort that the patient experiences during rehabilitation. The secondary and tertiary phases of rehabilitation usually provide the patient with limited contact with health professionals and place more reliance on their ability to follow and continue a prescribed rehabilitation plan.

The secondary and tertiary phases of rehabilitation are the critical points in the total rehabilitation process which are required to regain maximum benefit. Periodic structured exercises are prescribed by the physician for the patient to complete independently or in conjunction with visits to a physical therapist. The present system will ensure that patients complete specific exercises correctly which will enhance and expedite the total rehabilitation process.

Many devices have been patented which have attempted to solve the problem of providing adequate physical therapy to a person that is healing from an injury or otherwise is involved in muscular rehabilitation. U.S. Pat. No. 4,089,330 entitled "Physical Therapy Apparatus and Method" shows a physical therapy apparatus which is provided for increasing the range of motion of joints such as the knee and elbow joints that have lost their normal range of mobility. That patent includes a support for positioning and supporting the upper limb of the arm or a leg, a cradle for positioning and supporting the lower limb of the same arm or leg which are pivotally connected to the support so that the resulting axis of rotation coincides with the axis of rotation of the joint between the lower and upper limb positioned thereon. The device however provides a relatively limited degree of motion in a single plane.

Another physical therapy device is the Stahmer U.S. Pat. No. 3,618,595 entitled "Physical Therapy Device with a Versatile Adjusting and Mounting Means." That patent uses a rotating wheel to which is attached a flexible strap that can be grabbed or held by the patient.

Several patents use the concept of a rotating wheel to which is attached both hands or both legs of a patient so that rotation of the wheel moves the hands or feet of a disabled or injured person in a rotating path. Notice for example the Peters U.S. Pat. No. 4,402,502 entitled "Exerciser for Disabled Persons," the Swenson U.S. Pat. No. 4,185,622 entitled "Foot and Leg Exerciser;" and the Heilbrun U.S. Pat. No. 4,355,633 entitled "Adjustable Multi-Function Rotary Exercise Apparatus."

Many reciprocating type exercising machines move the legs forward and backwardly in a walking type fashion. Notice for example the Soderberg U.S. Pat. No. 3,824,994 entitled "Reciprocating Walker."

Most of these described devices which have been patented are very limited in the range of motion which can be imparted to a given appendage as part of a rehabilitation program.

The present invention provides a substantially universal muscular rehabilitation apparatus having universal adjustment through multiple geometric positions allowing the movement of the appendage with respect to the body to be varied in degree of motion, angular position of movement with respect to the body, and elevation of the arm or other appendage during such movement. Thus with the present invention, a full range of movement of a given appendage can be achieved such as for example arcuate movement of the arm above or below the waist, up and down with respect to the body, forward and aft with respect to the body as well as diagonally as part of an overall comprehensive rehabilitation program. The apparatus includes a support base to which is attached a curved track that is mounted for universal adjustable movement upon the base. The track defines a precise arcuate path which tracks the outer extremity of an human appendage such as the arm as that appendage pivots about a joint even during repetitive counts of an exercise routine. For example, if the appendage were the arm, the track defines a path tracked by the hand as the arm is extended fully and rotates about the shoulder. A carriage is mounted upon the track and is movable between the end portions of the track, thereby forming a moving vehicle to which the appendage extremity such as the hand for example, can be attached. In use, the carriage can be gripped at a handle which is provided thereon. Alternately, the hand can be affixed to the handle of the carriage by taping, strapping, or the like so that the hand will remain with the carriage even when the patient is injured to the point that he cannot grip the handle. In this manner, universal movement of the arm with respect to the body is achieved. For example, the track can be rotated into a vertical plane position so that rotation of the arm begins at the thigh and then proceeds upwardly in an arcuate path until the hand is above the head. Alternately, the hand and arm can move through a horizontal plane beginning for example in front of the patient, moving rearwardly to a position behind the patient, yet the arm movement occupies an entirely horizontal plane. Any angular variation of the above described orientation can be achieved by adjustment of the track with respect to the stand. Of course, universal adjustability of the track with respect to the base gives the creative therapist a virtually unlimited number of exercise "stations" to customize an exercise program to fit each patient's needs.

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF THE PRESENT INVENTION

Figure 1:
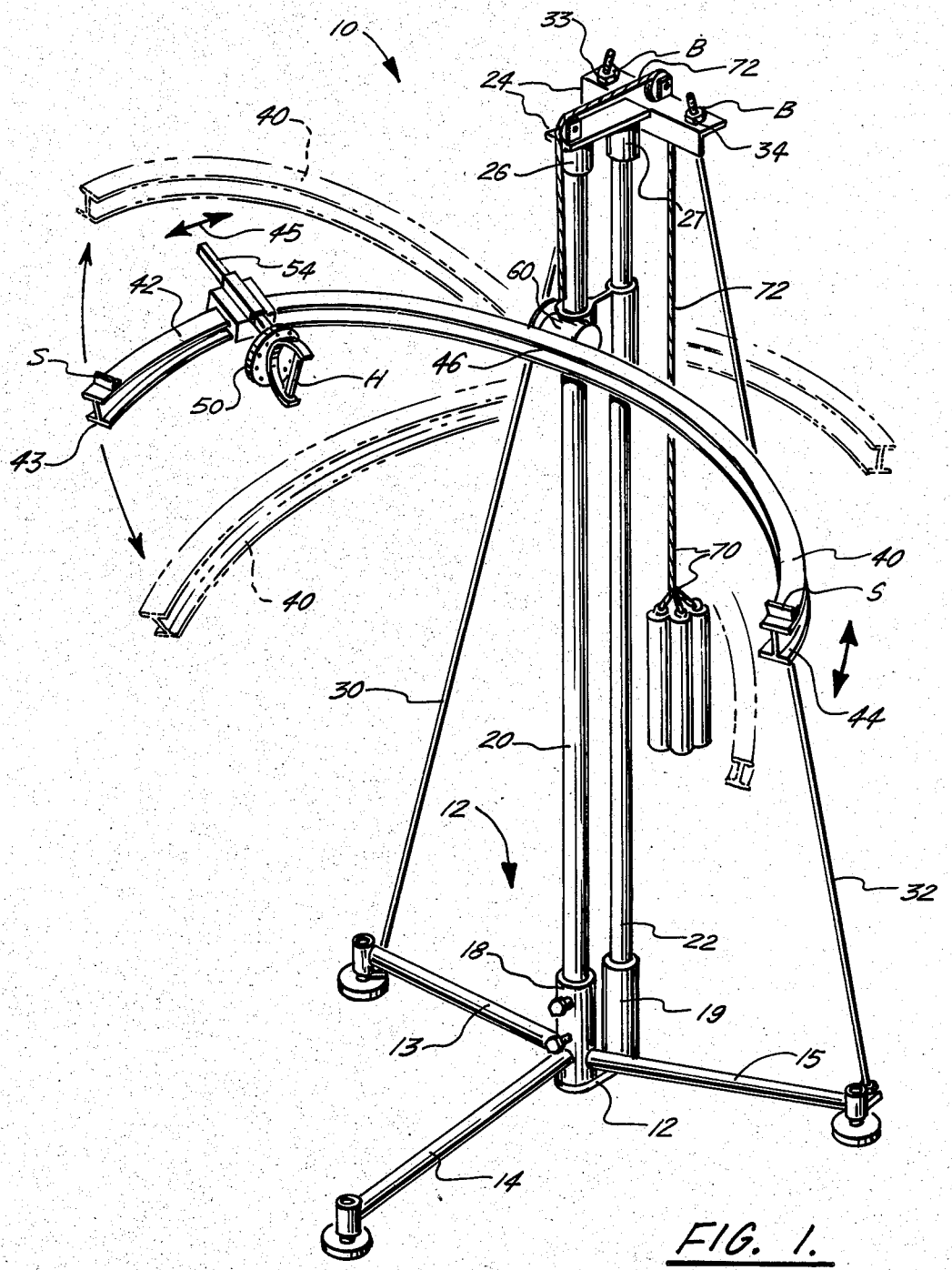
FIG. 1 is a perspective view of the preferred embodiment of the apparatus of the present invention.
Figure 2:
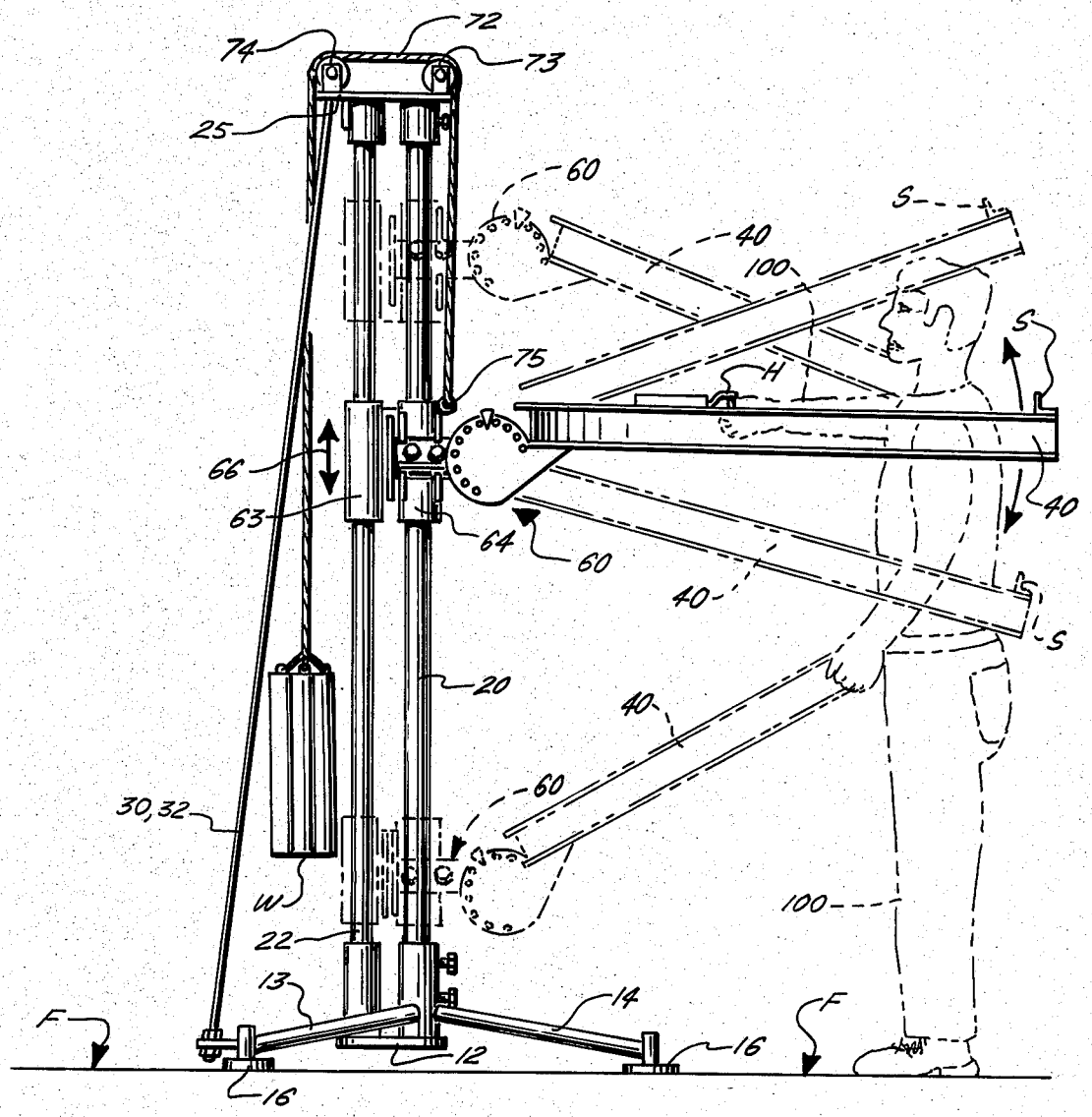
FIG. 2 is a side elevational view thereof.

FIGS. 1 and 2 best illustrate the preferred embodiment of the apparatus of the present invention designated generally by the numeral 10.

In FIGS. 1 and 2 there can be seen a support base 12 having a plurality of feet 13, 15 each equipped with a round caster 16 which can be threadably attached to the respective foot 13, 14 so that rotation of each caster 16 effects a change in elevation of the particular foot with respect to its foot 13–15 so that the apparatus can be plumbed or otherwise adjusted into a proper level orientation upon a supporting surface such as a floor F.

The support base includes preferably one or more upstanding vertical supports 20, 22 which are preferably uniform sections of rounded tubular material. A pair of sockets 18, 19 are attached by welding for example, to the feet 13, 15 and each socket provides an opening into which vertical members 20, 22 can be placed.

The upper end portions of vertical members 20, 22 are affixed with respect to each other by means of top bracket 24 which includes in combination a T-shaped beam section 25 attached to a pair of spaced apart sockets 26, 27 each of which includes an opening into which the upper end portion of each vertical member 20, 22 can be inserted. A pair of spaced apart tie rods 30, 32 rigidify vertical members 20, 22 on base 12 by spanning between feet 13 and 15 respectively and the upper support bracket 24. Openings 33, 34 in bracket 24 are provided for the attachment of tie rods 30, 32 thereto. Bolts B or similar fasteners are provided at the end portions of tie rods 30, 32 so that tightening of each tie rod 30, 32 can be perfected to increase the tension in each tie rod 30, 32 as desired. A similar connection can be used between tie rods 30, 32 and feet 13, 15.

A generally curved arcuate beam 40 provides a track 42 upon which carriage 50 travels during operation. Carriage 50 moves between the end portions 43, 44 of beam 40 as shown by the arrow 45 in FIG. 1. Stops S can be affixed to the ends 43, 44 of beam 40 to prevent unadvertant removal of carriage 50 therefrom.

The central 46 portion of beam 40 is adjustably affixed to vertical supports 20, 22 with universal connection 60 (see FIG. 4), so that beam 40 can: (1) change elevation position on supports 20, 22; (2) rotate upon connection 60 with respect to supports 20, 22; and (3) angulate with respect to connection 60.

Connection 60 includes a sliding bracket 62 which comprises spaced apart vertical sleeves 63, 64 joined by plate 65. Sleeves 63, 64 have central openings so that vertical members 20, 22 can pass therethrough. Adjustable connection 60 comprises generally bracket 62, universal joint 85 and beam carrier 90. Universal joint 85 includes sleeve 88 having an open ended bore 87. One end of sleeve 88 includes beam hook 89 which registers with the top flange of beam 40. The lower flange of beam 40 rests upon the two spaced apart beam support gussets 93, 94 which are a part of beam carrier 90. Beam carrier 90 includes a sleeve to which end plates 91, 92 are affixed by bolting or welding. Each plate has an extending gusset 93, 94 sized to register with the bottom flange of beam 40. Bolted connection B of carrier 90 cooperates with opening 89A of joint 85 to affix the rotational position of carriage 90. Bracket 62 also includes horizontal sleeve 66 having an open ended bore 67 that is receptive of universal joint 85. Set screws S are threadably affixed to horizontal sleeve 66 so that when set screws S are tightened, they can rigidify the rotational position of universal joint 85 within sleeve 66 bore 67. When loosened, set screws S allow a free rotation of universal joint 85 within sleeve bore 67.

Figure 4:
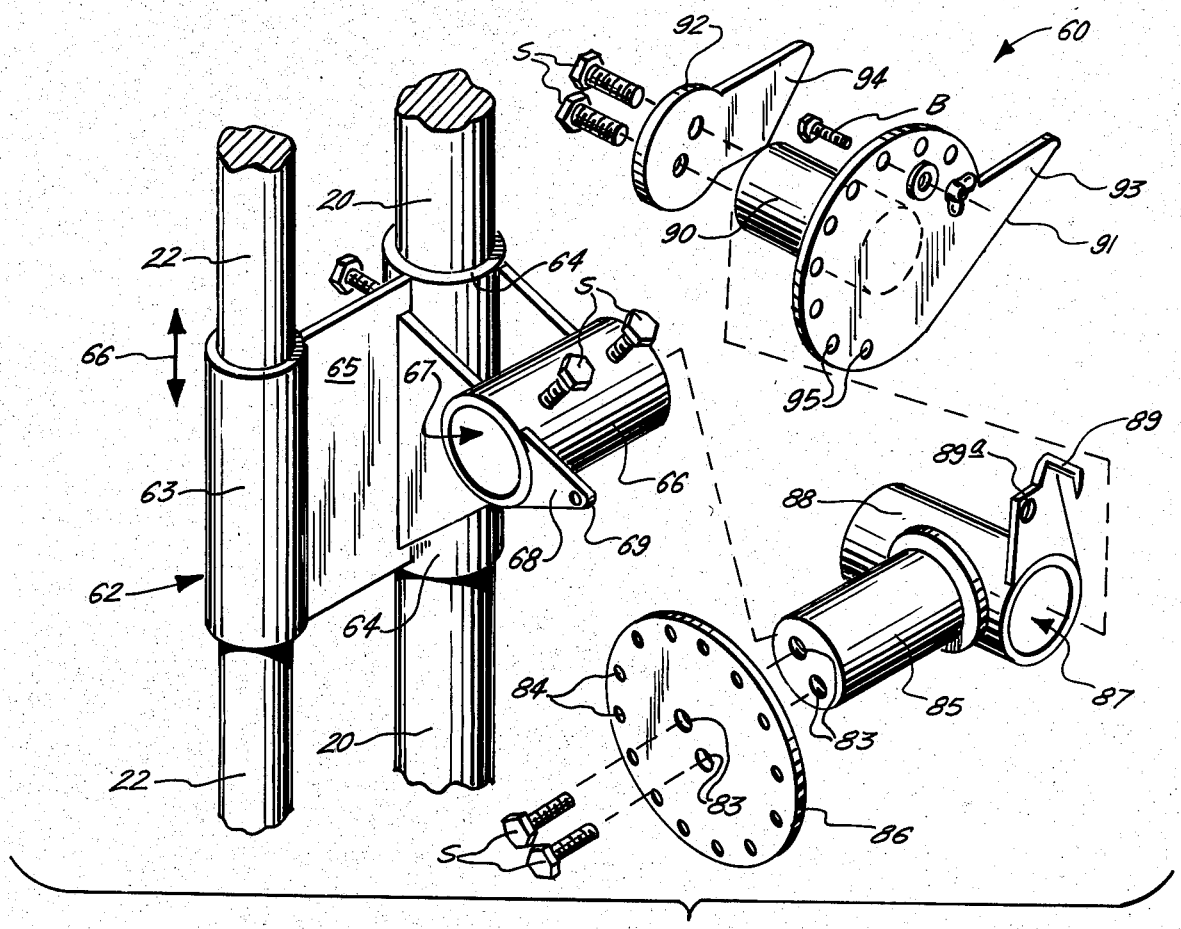
FIG. 4 is a fragmentary perspective exploded view of the preferred embodiment of the apparatus of the present invention illustrating the adjustable universal connection between the frame support and curved track.

The entire assembly of sleeves 63, 64 and plate 65 can move upwardly on members 20, 22 and downwardly as shown by the arrows 66 in FIG. 4. Counterweight assembly 70 can aid in counterbalancing the weight of beam 40 and connection 60. Counterweight system 70 includes an elongated flexible cable 72 to which is attached at one end one or more weights W. The opposite end portion of cable 72 is threaded upon a pair of spaced apart pulleys 73, 74 and then connects to adjustable connection 60 at eyelet 75.

Figure 3:
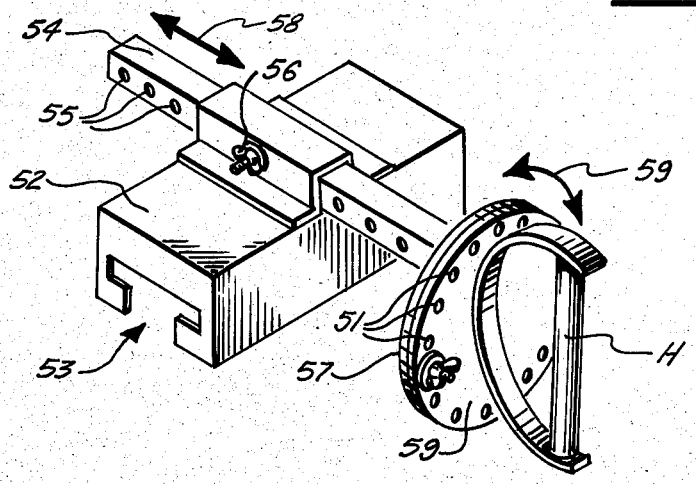
FIG. 3 is a fragmentary view of the preferred embodiment of the apparatus of the present invention illustrating the carriage portion.
Figure 5:
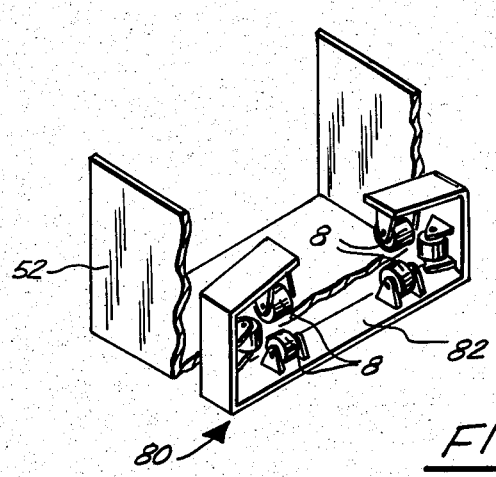
FIG. 5 is a fragmentary view of the carriage portion of the preferred embodiment of the apparatus of the present invention.

FIGS. 3 and 5 illustrate carriage 50 which comprises a rectangular frame 52 having more particularly, T-shaped sockets 53 on each end portion with an open space running therethrough so that the sockets can ride upon the beam 40. Sockets 53 correspond to the cross section of beam 40 and more particularly to the flange and web portion thereof as shown in FIG. 1. Beam 40 is preferably an I-beam in section. Sockets 53 coincide with the uppermost flange and the web portion of the I-beam section. However, other beam sections such as a T-beam or channel could be used, with corresponding socket shapes being provided for carriage 50 so that the carriage can travel on beam 40 between its end portions and remain affixed thereto during operation. Carriage 50 includes a handle H for hand gripping by a user as shown in FIG. 2. In FIG. 2, the user is shown in phantom lines as 100. Handle H connects to carriage 50 by means of an elongated shaft 54 having a plurality of spaced apart openings 55 therein. A wing nut threaded connection for example, designated by the numeral 56 in FIG. 3 allows an adjustable connection of shaft 54 with respect to carriage 52. One skilled in the art will recognize that the shaft 54 can be adjusted with respect to the frame 52 by placing one of the selected openings 55 in the central position occupied by bolted connection 56. The arrow 58 in FIG. 3 illustrates the adjustment of shaft 54 with respect to carriage 52. The shaft 54 adjustment allows adjustability for users of different size. The user's shoulder joint preferably occupies a position at the radial center of the arc defined by beam 40. Shaft 54 adjustment on frame 52 allows this sizing to be done.

A rotational connection, designated generally by the numeral 59 and the curved arrow associated therewith, can be obtained for handle H with respect to carriage frame 52. Thus, handle H joins shaft 54 by means of a pair of disks 57, 59. Each disk 57, 59 is provided with a plurality of corresponding radially spaced peripheral openings 51 through which a bolted connection B can be placed to affix the position of one disk 57 with respect to the other disk 59. Thus any rotational position of handle H with respect to carriage frame 52 can be achieved as desired during a particular rehabilitation program.

FIG. 5 illustrates an internal cut-away view of carriage 52 which contains one or more guide wheel structures, designated generally by the numeral 80. Each guide wheel structure 80 includes support bracket 82 having affixed thereto a plurality of wheels 83 which are positioned to engage the flanges and web of beam 40.

Because many varying and different embodiments may be made within the scope of the inventive concept herein taught, and because many modifications may be made in the embodiment of the law, it is to be understood that the details herein are to be interpreted as illustrative and not in a limiting sense.

What is claimed as the invention is:

1. A muscular rehabilitation apparatus for exercising the human body appendages of a user through multiple geometric positions of the appendage with respect to the user's body, comprising:

a. a support base;

b. a curved track mounted for adjustable movement upon the base into multiple elevational positions including at least a position near the head of the user when standing;

c. the track defining an arcuate path which tracks the outer extremity of a human appendage as it pivots about a joint thereby defining an exercise plane occupied by the appendage and the track;

d. carriage means mounted to move on the track between the end portions thereof for forming a connection to the appendage extremity; and e. articulating adjustment means movably mounted with the track upon the base upwardly and downwardly for affixing the curved track to the base and in multiple preselected positions with respect to the base including multiple elevational positions, multiple rotational positions wherein the track and the exercise plane can rotate with respect to the user, and multiple angular positions wherein the track and the exercise plane can form different angles with a horizontal plane.

2. The muscular rehabilitation apparatus of claim 1 wherein the base includes a vertical column support and the adjustment means includes a rotational connection of the track with respect to the vertical column portion of the base.

3. The muscular rehabilitation apparatus of claim 2 wherein the adjustment means includes an elevational adjustment connecting the track with the vertical column portion of the base.

4. The muscular rehabilitation apparatus of claim 3 wherein the adjustment means includes an angular adjustment of the track with respect to the vertical column portion of the base.

5. The muscular rehabilitation apparatus of claim 1 wherein the base includes a vertical post and the adjustment means includes a sleeve that forms a movable connection with the post so that the track and the adjustment means can move up and down with the sleeve upon the post.

6. The muscular rehabilitation apparatus of claim 1 wherein the track forms an arc of a circle.

7. The muscular rehabilitation apparatus of claim 1 wherein the track has a uniform cross section.

8. The muscular rehabilitation apparatus of claim 1 wherein the carriage means has a handle with a gripping surface thereon.

9. The muscular rehabilitation apparatus of claim 1 wherein the carriage means is a wheeled carriage that rolls upon the track.

10. The muscular rehabilitation apparatus of claim 1 wherein the handle is extensible from the carriage toward the center of rotation of the track.

* * * * *